US012781138B2

(12) United States Patent
Fontes et al.

(10) Patent No.: US 12,781,138 B2
(45) Date of Patent: Nov. 3, 2026

(54) PROCESS AND SYSTEM FOR EXTRACTION OF AQUEOUS FLUIDS IN PETROLEUM PRODUCED WITH LOW WATER CONCENTRATION FOR ITS CHARACTERIZATION

(71) Applicants: PETRÓLEO BRASILEIRO S.A.-PETROBRAS, Rio de Janeiro (BR); UNIVERSIDADE FEDERAL DE ITAJUBÁ-UNIFEI, Itajubá (BR)

(72) Inventors: Rosane Alves Fontes, Rio de Janeiro (BR); Marcos Aurélio De Souza, Itajubá (BR); Stefan Suarez Ferreira, Rio de Janeiro (BR); Felipe Batista Alvim, Rio de Janeiro (BR); Alexandre Barbosa Melo De Carvalho, Rio de Janeiro (BR); Monica Teixeira Da Silva, Rio de Janeiro (BR); Jussara De Mello Silva, Rio de Janeiro (BR); Leonardo Dos Santos Pereira, Rio de Janeiro (BR); Tiago Cavalcante Freitas, Rio de Janeiro (BR); Luiz Fernando Barca, Itajubá (BR); Giselle Maria Lopes Leite Da Silva, Rio de Janeiro (BR)

(73) Assignees: Petróleo Brasileiro S.A.-Petrobras, Rio de Janeiro (BR); Universidade Federal de Itajubá-UNIFEI, Itajubá (BR)

( * ) Notice: Subject to any disclaimer, the term of this patent is extended or adjusted under 35 U.S.C. 154(b) by 202 days.

(21) Appl. No.: 18/763,550

(22) Filed: Jul. 3, 2024

(65) Prior Publication Data

US 2025/0026989 A1 Jan. 23, 2025

(30) Foreign Application Priority Data

Jul. 18, 2023 (BR) ..... BR 1020230143610

(51) Int. Cl.
*C10G 33/08* (2006.01)

(52) U.S. Cl.
CPC ..... *C10G 33/08* (2013.01); *C10G 2300/4006* (2013.01)

(58) Field of Classification Search
CPC ..... C10G 33/08; C10G 2300/4006; C10G 33/04
See application file for complete search history.

(56) References Cited

U.S. PATENT DOCUMENTS 4,477,337 A * 10/1984 Ronden ..... C10G 33/04 208/229
2012/0024758 A1* 2/2012 Love ..... B01D 21/262 208/187

* cited by examiner

*Primary Examiner* — Prem C Singh
*Assistant Examiner* — Juan C Valencia
(74) *Attorney, Agent, or Firm* — Sterne, Kessler, Goldstein & Fox P.L.L.C.

(57) ABSTRACT

The present invention relates to a process and system capable of processing large volumes of petroleum samples to withdraw a sufficient amount for water characterization in petroleum, without the need for sample fractionation and subsequent volume recomposition. This reduces the number of steps and processing time, with low risk of contamination or decharacterization due to losses of important fractions. This process is carried out through the system consisting of the insulated and heated reservoir (1), temperature transmitter (2), temperature controller (3), resistor (4), flow control valve (5), blocking valves (6*a;* 6*b;* 6*c;* 6*d*), temperature indicator (7), self-desludging stacked plate centrifuge (8), oil sampling point (9), water sample extraction system (10), capillary tube (11), vacuum pump (12), water sample container (13), oil outlet (15), water inlet for activating the desludging (16), cleaning fluid inlet (17), outlet or vent (18).

11 Claims, 2 Drawing Sheets

PROCESS AND SYSTEM FOR EXTRACTION OF AQUEOUS FLUIDS IN PETROLEUM PRODUCED WITH LOW WATER CONCENTRATION FOR ITS CHARACTERIZATION

FIELD OF THE INVENTION

The present invention refers to a process and system capable of processing large volumes of petroleum samples, on the order of tens of liters, to remove a sample sufficient to characterize the chemical composition of water in petroleum, without the need for fractionating said sample and the subsequent recomposition of the volume of the water sample that would potentially harm its quality. Thus, the present invention significantly reduces the number of steps and processing time with low risk of contamination or decharacterization due to losses of important fractions.

The proposed process and system can be used in modeling, simulation and evaluation of reservoirs, in petroleum production and in lifting and flow technologies.

BACKGROUND OF THE INVENTION

Determining the composition of formation water in a reservoir is of great interest in petroleum exploration and production, both in the water zone and in the petroleum zone. Often, petroleum samples from producing wells are sent to the laboratory for a water sample to be separated to characterize its chemical composition. The separation of this water sample involves the use of chemical products, such as demulsifiers, and centrifugation of the samples, normally fractionated in centrifuge tubes operating in multiple batches.

Usually, the crude oil samples, from which the water samples are taken, are transported to the laboratory in 20 L containers (two containers, totaling 40 L of sample). Subsequently, a demulsifier is added to these containers for processing in the water-in-petroleum oil emulsion demulsification mechanism. The separation of water from oil is carried out in a tube centrifuge, and for this purpose the sample is generally divided into 250 mL units. The fractionated sample is then heated and centrifuged, with a water-rich aliquot separated and swollen when combined with other water-rich aliquots from other tubes. Subsequently, the centrifugation process in a tube centrifuge is carried out again. Said aliquot of separated and voluminous water constitutes the water sample. Generally, this operation takes 32 to 48 hours of processing. In this usual methodology, there is a large number of fractionations of oil samples containing water and compositions of the water sample, demanding time and involving risks of decharacterization of samples. The problem becomes much more critical in oil samples with very low water content, for example, of less than 0.5%.

With the exploration of the Pre-Salt Pole, the characterization of water from new wells became essential due to the high concentrations of salts in the petroleum, despite the low water content, resulting in a significant level of scale. In these new wells, the water concentration is often in the order of 0.5%, which leads to the need to handle large quantities of oil until a volume of water is obtained that constitutes a sufficient sample to characterize the water chemical composition. With the usual procedures, this implies the need for large fractionation of the oil samples and subsequent need to increase the water sample, demanding a lot of time and bringing risks of potential alteration of the physical-chemical characteristics of the water removed, whether due to contamination or handling losses.

Considering the problems reported above, we sought to develop a process and a system for extracting aqueous fluids from petroleum produced with a low concentration of water to characterize its chemical composition, without the need for fractionation and recomposition of the sample volume.

SUMMARY OF THE INVENTION

The present invention has its application in the extraction of water samples in petroleum to characterize its chemical composition since exploration and during the production of the reservoir, where despite the low concentration of water in petroleum being a preponderant factor, signs of scaling are already found. The process and system of the present invention do not require fractionation or recomposition of the volume of said sample.

BRIEF DESCRIPTION OF THE FIGURES

The present invention will be described below, with reference to the attached Figures which, schematically, and not limiting the inventive scope, represent examples of its embodiment.

DETAILED DESCRIPTION OF THE INVENTION

Figure 1:
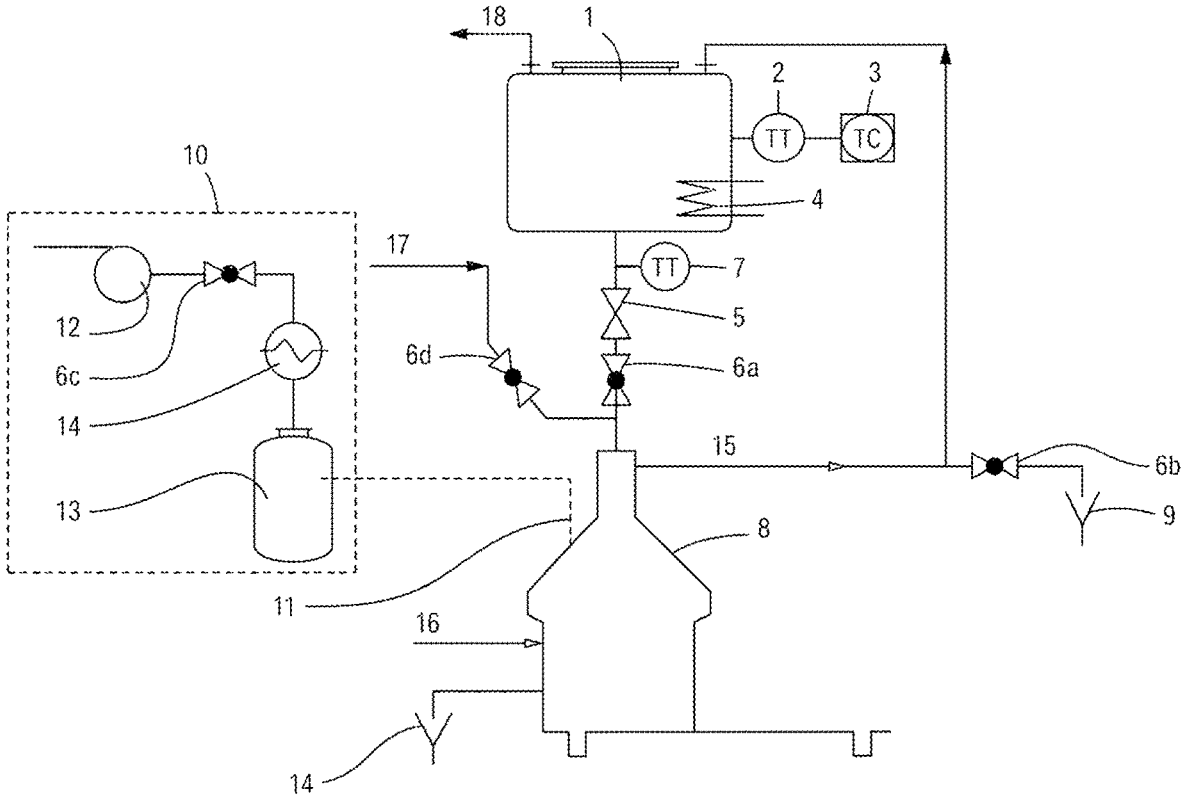
FIG. 1 illustrates a centrifugal skid diagram of the system of the present invention.

The present invention relates to a process and system capable of processing bulky petroleum samples to remove a sufficient sample for characterizing the water in petroleum.

Through the process and system of the present invention, the sample required to extract water for its characterization can be reduced to half that used by the usual state of the art. Through the invention, the volume of sample processed in a single batch is significantly larger, and can constitute a water sample without the need to fractionate the crude oil sample. In this way, sample handling is reduced, thus minimizing risks of contamination and sample decharacterization or losses of important fractions. Additionally, as can be seen in table 1 of example 1, the reduction in the time required to process the sample is quite significant.

The water sample is removed from the inside of the self-desludging stacked plate centrifuge (8) through an exclusive pipe, before desludging the centrifuge (8) and without the need to disassemble its rotor. Thus, the number of steps and processing time are significantly reduced with low risk of contamination or decharacterization due to losses of important fractions.

The process for extracting aqueous fluids from petroleum produced with a low concentration of water for its characterization comprises the steps of:

(a) obtain several oil samples with emulsified water at a very low concentration, in which the water content is less than 1%, preferably 0.5%, in volumes of 15 to 18 L of oil sample using 20-liter nominal capacity oil containers;

(b) heating the containers containing the samples in a water bath using an electric heater at a temperature varying between 40° C. and 60° C., depending on the API degree of the oil, which can vary between 2° and 30° API. Lower API values will require more heating;

(c) adding to the heated oil a graphitized copolymer type demulsifier, such as polyethylene oxide-b-propylene oxide (PEO-b-PPO), used at a concentration between 150 and 200 ppm;

(d) shaking the container vigorously until homogenization is achieved, thus ensuring good distribution of the demulsifier in the sample, where stirring can be manual or mechanical (through the revolution of the drum around its horizontal axis at a rotation of 12 rpm for a time between 5 and 10 minutes);

(e) keeping the container at rest for 12-24 hours;

(f) preheating the contents of the container and pour it into the insulated reservoir (1), where the temperature is measured by the transmitter (2), adjusted and then controlled by the controller (3), which activates a resistor (4);

(g) releasing the flow, through the blocking valve (6*a*, 6*b*; 6*c*; 6*d*), after stabilizing the temperature at values between 45 and 60° C.;

(h) regulating the oil flow to the self-desludging stacked plate centrifuge (8) by activating the control valve (5), in which inside the centrifuge rotor (8), water and oil are separated by the action of the centrifugal field, so that the water is concentrated on the rotor periphery;

(i) recirculating the separated oil, through the action of the centrifugal field, to the reservoir;

(j) after recirculating the inventory at least twice, withdrawing an oil sample through the sampling point (9), measuring the residual water concentration in this sample and comparing it with the water concentration measured in the original sample;

(l) repeating the procedure from steps (h)-(j), after one or two more successive recirculations of the inventory, until the concentration of residual water in the oil is stabilized, when it is considered that the separation process has ended;

(m) once the separation is complete, connecting the separation system (10) to the capillary tube (11), which is introduced into the centrifuge rotor in the water accumulation region;

(n) subsequently, aspirate the water sample using the vacuum pump (12) and accumulate it in container (13);

(o) once the water sample has been withdrawn, proceed with the desludging of the self-desludging stacked plate centrifuge (8) and drain the oil reservoir. Desludging is a procedure that can be performed by injecting water into the specific connection (16) and using it to remove residues from the centrifuge (8) rotor; and (p) after the desludging step, clean the centrifuge (8) with water-free mineral oil, added through the cleaning fluid inlet (17) and the reservoir (1).

After step (p), the system is ready for processing a new sample.

Optionally, if the high temperature may cause loss of water in the form of steam, a condenser (14) can be installed between the vacuum pump (12) and the container (13), so that the steam condenses and the water returns by gravity to the container (13).

The present invention also describes a system for extracting aqueous fluids from petroleum produced with low concentration of water for its characterization as it consists of an insulated and heated reservoir (1), temperature transmitter (2), temperature controller (3), resistor (4), flow control valve (5), blocking valves (6*a*; 6*b*; 6*c*; 6*d*), temperature indicator (7), self-desludging stacked plate centrifuge (8), oil sampling point (9), water sample extraction system (10), capillary tube (11), vacuum pump (12), water sample container (13), oil outlet (15), water inlet for activating the desludging (16), cleaning fluid inlet (17), outlet or vent (18). The system may also optionally consist of a condenser (14) between the vacuum pump (12) and the container (13).

Below, examples of embodiments (tests and results) of the present invention will be defined, without limiting the inventive scope.

Exemplary Embodiment/Tests and Results

Figure 2:
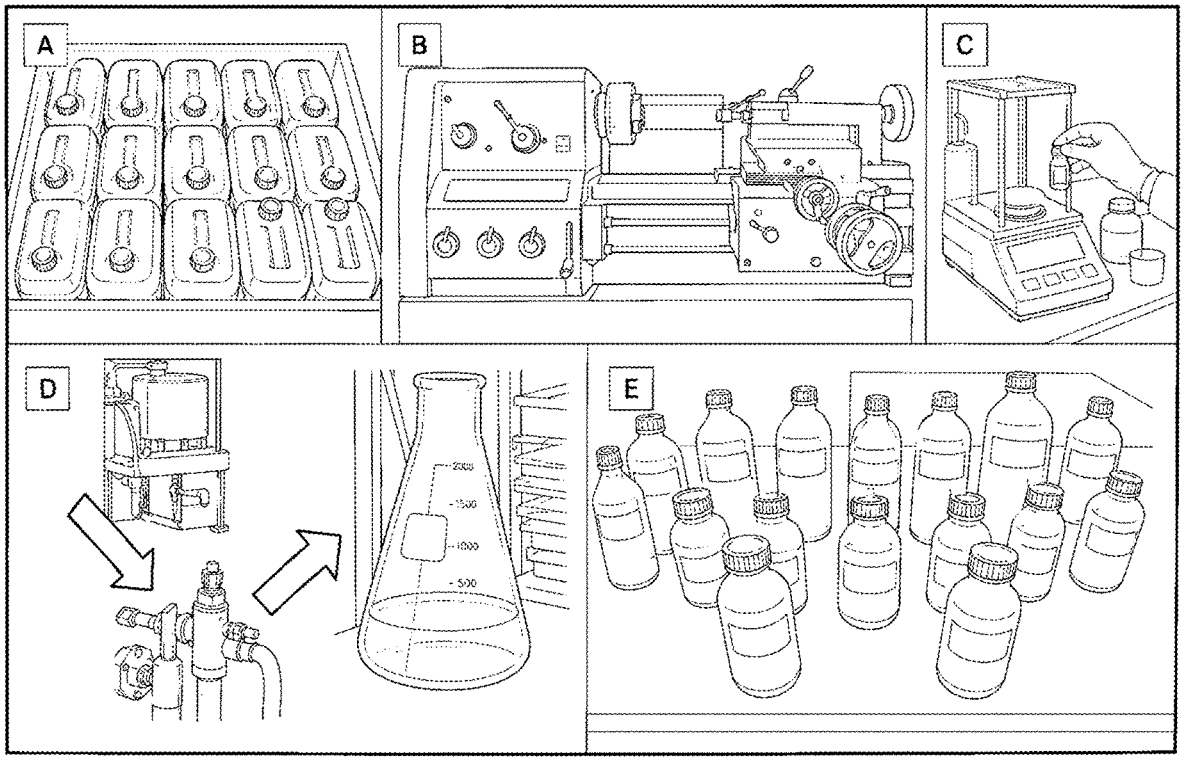
FIG. 2 illustrates an example of the sampling processing of the process of the present invention.

FIG. 2 illustrates the processing used in the present Example through (A) Samples of 20 L containers with produced oil being dehydrated; (B) Stirring device coupled to a self-desludging stacked plate centrifuge; (C) Karl Fischer 870 Titrino plus used to quantify the water content in the oil; (D) Water recovery system resulting from the oil centrifugation process; (E) Samples stored and identified ready for analysis.

In this regard, several samples of oil with emulsified water at very low concentrations, with water content below 1%, were sent for processing in 20-liter containers, containing approximately 15-18 liters of produced fluid, from different pre-salt wells in the Santos Basin, as illustrated in FIG. 2(A). Initially, each of the oil containers was heated in a water bath using an electric heater, at a temperature ranging from 40° C.-60° C., depending on the API degree of the oil, which can vary between 20-30° API. While still heated, the sample was stirred for 10 minutes using a device designed for stirring in the self-desludging stacked plate centrifuge (FIG. 2(B)). Following stirring, a 200 mL oil sample was extracted for storage as a reference sample and for quantifying the water content using the Karl Fischer titration method (FIG. 2(C)). To the heated oil, a chemical demulsifier of the polyethylene oxide-b-propylene oxide copolymer (PEO-b-PPO) type was added. However, other graphitized copolymers can be used as they have similar physical-chemical properties. The container was shaken vigorously, at 12 rpm for a period of between 5-10 minutes, until homogenization, thus ensuring good distribution of the demulsifier, and then, it was kept at rest for 12-24 hours.

During the test, to monitor the centrifugation process, oil samples were taken from the centrifuge feed reservoir at different times (t0 and t45) to quantify the water content present in the oil. t0 indicates the water content in the starting oil for treating the oil in the centrifuge; and t45 indicates the water content in the oil after forty-five minutes of centrifugation or the final water content at the end of the test. The samples were collected with a 5 mL syringe, and a known quantity of oil, preferably 5 mL, was inserted into the Karl Fischer equipment to quantify the water content. For each syringe with oil sample, Karl Fischer tests were carried out in triplicate and the result was calculated based on the average of this triplicate. At the end of the separation process, represented illustratively in FIG. 2(D), all samples resulting from each test were collected and duly identified for sending to Cenpes for analysis (FIG. 2(E)).

In total, in this Example, approximately 150 samples of crude oil were processed with an average water separation efficiency of 93%, as shown in Table 1 below:

TABLE 1

Processing of crude oil samples

| Project phases | Number of samples | Average water content (%) at t0 | Average water content (%) at t45 | Water removal efficiency (%) | Hours - continuous flow of the inventive process | Hours - continuous flow of the conventional process |
|---|---|---|---|---|---|---|
| 01 | 45 | 0.61 | 0.04 | 93 | 90 | 1620 |
| 02 | 54 | 1.04 | 0.04 | 96 | 108 | 1944 |
| 03 | 56 | 0.98 | 0.09 | 91 | 112 | 2016 |

More than 150 samples of produced fluids from the Pre-Salt Pole in the Santos Basin were treated, with BSW (Basic Sediments and Water) ranging between 0.5% and 1%. The processing time to obtain the aqueous phase was reduced by approximately 95%, decreasing from 5580 hours to 310 hours. Additionally, the process of the present invention was successfully applied to samples with 0.35% BSW from the Búzios and Mero fields, comprising the initial results of comprehensive chemical characterization of produced aqueous fluids from these fields.

As noted in the examples above, the technology was able to recover produced water from fluids with water content below 1% in approximately 2 hours of processing, providing a sufficient sample quantity for comprehensive chemical composition characterization and support for scale management. It is worth noting that, in the state of the art, a volume of 40 L is used, in two 20 L containers, whereas in the present invention, a 20 L container was used, with a sample volume between 15 and 18 L. It can also be applied to obtain information on water associated with the oil zone, including producing zones within the same well, which can provide strategic insights into scale management and reservoir connectivity. Consequently, the following advantages can be observed through the use of the process and system of this invention:

Economics/Productivity

Significant reduction in the time required to obtain water samples for subsequent comprehensive chemical characterization, enabling the processing of 5 samples with BSW less than 1% per day, assuming administrative working hours.

Sample processing can be carried out near oil exploration sites, eliminating the need for long-distance transportation. This not only reduces costs but also minimizes the response time required for decision-making.

Health/Safety

Reduction in handling and contact with oil samples, from which water needs to be extracted. There is no need to fractionate oil samples, reducing risks by eliminating operations.

Reliability

The samples can be considered more representative and reliable due to the reduction in fractionation and handling.

Environmental

Reduction in chemical usage (lower concentrations of demulsifier) as well as smaller oil sample volumes (50% less), leading to reduced effluent generation.

Other Advantages

Therefore, the process and system of the present invention have proven effective in extracting aqueous fluids from produced petroleum with low water concentration for characterization of its chemical composition.

The invention claimed is:

1. A process for extracting aqueous fluids from petroleum produced with a low concentration of water for its characterization, comprising the steps of:

(a) obtaining oil samples with emulsified water where the water content is less than 1%, in volumes ranging from 15-18 liters of oil sample using oil containers;

(b) heating the oil containers containing the samples to a temperature ranging from 40° C.-60° C.;

(c) adding to the heated oil a graphitized copolymer demulsifier;

(d) stirring the oil container manually or mechanically until achieving homogenization of the sample with the demulsifier;

(e) keeping the oil container at rest for 12-24 hours;

(f) preheating the contents of the oil container and pouring it into an insulated reservoir wherein the temperature is measured by a transmitter, adjusted, and then controlled by a controller, which activates a resistor;

(g) releasing the flow, through a blocking valve, after stabilizing the temperature at values between 45° C. and 60° C.;

(h) regulating the oil flow rate to a self-desludging stacked plate centrifuge by operating a control valve, wherein inside a centrifuge rotor, water and oil separate due to the centrifugal force, with water concentrating on the rotor periphery;

(i) recirculating the separated oil, through the action of the centrifugal field, to the reservoir;

(j) after recirculating the inventory at least twice, withdrawing an oil sample through the sampling point, measuring the residual water concentration in this sample, and comparing it with the water concentration measured in the original sample;

(l) repeating the procedure from steps (h)-(j), after one or two more successive recirculations of the inventory;

(m) once the separation is complete, connecting the separation system to a capillary tube introduced into the centrifuge rotor in the water accumulation region;

(n) subsequently, aspirating a water sample using a vacuum pump and accumulating it in the oil container;

(o) once the water sample has been withdrawn, proceeding with the desludging of the self-desludging stacked plate centrifuge by injecting water into a specific connection and using it to remove residues from the centrifuge rotor of the self-desludging stacked plate centrifuge and, afterward, draining the oil reservoir; and (p) after the desludging step, cleaning the centrifuge with water-free mineral oil added through a cleaning fluid inlet and the reservoir.

2. The process of claim 1, wherein the water content of step (a) is 0.5%.

3. The process of claim 1, wherein the oil container has a nominal volume of at least 20 L.

4. The process of claim 1, wherein the demulsifier comprises polyethylene oxide-b-propylene oxide (PEO-b-PPO).

5. The process of claim 1, wherein the concentration of the demulsifier is between 150 ppm and 200 ppm.

6. The process of claim 1, wherein mechanical rotation occurs through the revolution of a drum around its horizontal axis at a speed of 12 rpm for a time between 5 minutes and 10 minutes.

7. The process of claim 1, further comprising recovering evaporated water through a condenser between the vacuum pump and the oil container.

8. The process of claim 1, wherein the sample volume is processed in a single batch.

9. The process of claim 1, wherein the water sample is withdrawn from inside the self-desludging stacked plate centrifuge before desludging the self-desludging stacked plate centrifuge and without dismantling the centrifuge rotor.

10. A system for extracting aqueous fluids from petroleum produced with low concentration of water for its characterization, characterized in that it consists of an insulated and heated reservoir, a temperature transmitter, a temperature controller, a resistor, a flow control valve, blocking valves, a temperature indicator, a self-desludging stacked plate centrifuge, an oil sampling point, a water sample extraction system, a capillary tube, a vacuum pump, a water sample container, an oil outlet, a water inlet for activating the desludging, a cleaning fluid inlet, and an outlet or vent.

11. The system of claim 10, further comprising a condenser between the vacuum pump and the container.

* * * * *